US009205476B2

(12) United States Patent
Mullerleile

(10) Patent No.: US 9,205,476 B2
(45) Date of Patent: Dec. 8, 2015

(54) STRAIGHTENER

(71) Applicant: Kohler Maschinenbau GmbH, Friesenheim (DE)

(72) Inventor: Franz Mullerleile, Schuttertal (DE)

(73) Assignee: Kohler Maschinenbau GmbH, Friesenheim (DE)

( * ) Notice: Subject to any disclaimer, the term of this patent is extended or adjusted under 35 U.S.C. 154(b) by 143 days.

(21) Appl. No.: 14/036,416

(22) Filed: Sep. 25, 2013

(65) Prior Publication Data

US 2014/0083153 A1 Mar. 27, 2014

(30) Foreign Application Priority Data

Sep. 26, 2012 (DE) ..... 10 2012 217 493

(51) Int. Cl.
*B21D 1/02* (2006.01)

(52) U.S. Cl.
CPC ..... *B21D 1/02* (2013.01)

(58) Field of Classification Search
CPC ..... B21D 1/02; B21B 31/16; B21B 31/20; B21B 31/22; B21B 31/30
See application file for complete search history.

(56) References Cited

U.S. PATENT DOCUMENTS

| | | | | |
|---|---|---|---|---|
| 3,477,266 | A | 11/1969 | Fornataro | |
| 4,237,715 | A * | 12/1980 | Lutz | 72/244 |
| 5,189,896 | A | 3/1993 | Melzer et al. | |
| 5,479,809 | A * | 1/1996 | Stachuletz et al. | 72/244 |
| 5,680,785 | A * | 10/1997 | Quehen et al. | 72/10.1 |
| 6,993,947 | B2 | 2/2006 | Tondo et al. | |
| 8,127,580 | B2 | 3/2012 | Polatidis et al. | |
| 2003/0070466 | A1 * | 4/2003 | Horii et al. | 72/229 |
| 2008/0098786 | A1 | 5/2008 | Yoshioka | |

FOREIGN PATENT DOCUMENTS

| | | |
|---|---|---|
| CN | 1486225 | 3/2004 |
| CN | 101312797 | 11/2008 |
| CN | 102489554 | 6/2012 |
| CN | 202316675 | 7/2012 |
| DE | 1934496 | 1/1971 |
| DE | 2742043 | 5/1979 |
| DE | 2747331 | 7/1982 |
| DE | 102007051894 | 5/2008 |
| EP | 1673181 | 11/2007 |

* cited by examiner

*Primary Examiner* — Teresa M Ekiert
(74) *Attorney, Agent, or Firm* — Volpe and Koenig, P.C.

(57) ABSTRACT

A straightener for straightening a metal strip and/or flat metal parts, having a number of lower straightening rolls which are mounted in a lower roll frame and a number of upper straightening rolls which are mounted in an upper roll frame. Stay bolts connect the upper and lower roll frame at a preselectable spacing, the stay bolts being assigned adjusting apparatuses for changing an effective length of the stay bolts, which effective length defines the preselectable spacing, and for compensating for changes in the effective length during operation. The adjusting apparatuses include a mechanically movable sliding wedge which changes the effective length of the stay bolts.

8 Claims, 6 Drawing Sheets

STRAIGHTENER

INCORPORATION BY REFERENCE

The following documents are incorporated herein by reference as if fully set forth: German Patent Application No. 102012217493.1, filed Sep. 26, 2013.

BACKGROUND

The invention relates to a straightener for straightening a metal strip and/or flat metal parts. Accordingly, a straightener of the present type comprises a number of upper straightening rolls which are mounted in an upper roll frame and a number of lower straightening rolls which are mounted in a lower roll frame. The roll frames are connected to one another by a plurality of stay bolts, the stay bolts being attached to the roll frames in such a way that the roll frames are held at a preselectable spacing from one another. This makes it possible that a straightening gap which is formed between the upper and lower straightening rolls can be changed, in order for it to be possible to straighten material of different thickness in the straightener.

Straighteners of the present type serve to eliminate stresses and unevennesses in metal strips or metal parts. The upper and lower straightening rolls are arranged offset with respect to one another, with the result that the material to be straightened is guided through the straightening rolls in a type of sinuous line, that is to say is bent alternately upward and downward. The bending takes place in such a way that the material is bent beyond its yield point at least at the first straightening rolls, with the result that undesired bending and stresses are eliminated in the material as completely as possible. The material is usually plasticized to a very pronounced extent at the first straightening roll of the straightener. The material is bent to a somewhat lesser extent at every further straightening roll, and the material is no longer plasticized at the last straightening roll, that is to say is only deformed elastically.

In the metal-processing industry, metal strips are often used which are supplied as what are known as coils and are unwound therefrom for production purposes. As a result of the winding up of the strip material to form coils, but also as a result of any possible previous thermal treatments and the like, there are unevennesses and stresses in the strip material which are unfavorable for further processing. After being unwound from the coil, metal strips are therefore as a rule guided through a straightener of the present type which they leave in a flat and stress-free state.

However, this is not the only field of application, since flat metal parts which are to be freed from undesired bends and stresses, are also as a rule straightened in a straightener of the present type, in order for it to be possible to process them further. Here, in particular, the adjustability of the straightening gap in a straightener of the present type is utilized particularly advantageously, since the parts to be straightened often have a different thickness or have to be treated with different bending moments. In both cases, it is then necessary to adapt the straightening gap correspondingly.

If a metal strip or a flat metal part is moved through the straightening gap and is bent alternately around the upper and lower straightening rolls, very high opposing forces are naturally produced in the straightener, which opposing forces are directed at opening or widening the straightening gap. The roll frames and, in particular, the stay bolts which hold the roll frames in the desired position with respect to one another therefore have to be of correspondingly robust design. The stay bolts are subject to a tensile load by the opposing forces during straightening, which is rendered perceivable by an elongation of the stay bolts in the case of corresponding forces.

A known option for dealing with said problem comprises in configuring the stay bolts to be correspondingly robust, that is to say very solid. This entails the disadvantage that the straightener becomes very heavy overall and is correspondingly expensive to manufacture as a result of the required material.

Another option for avoiding the widening of the straightening gap during operation is to compensate for the elongation of the stay bolts, by their effective length being shortened, that is to say by counteracting the elongation. As long as strip material is being straightened, this can be brought about very simply by the fact that the stay bolts which are connected as a rule by means of threads to the roll frames are tightened and their effective length is thus shortened to such an extent that the straightening gap obtains the desired extent again. This is because, if the strip material has run into the straightener once and the stay bolts have been correspondingly lengthened, one-time readjustment of the effective length of said stay bolts is sufficient, in order to produce defined conditions for the rest of the coil.

However, this is different in the case of part straighteners, since, in the case of every flat metal part which runs into the straightener, the latter rears up, that is to say the stay bolts are lengthened and the straightening gap yields or opens, which cannot be compensated for by simple readjustment of the stay bolt mounting brackets. This is because the straightening gap would then narrow excessively when a straightened part leaves the straightener, with the result that the next part to be straightened cannot run correctly into the straightener.

In order to solve this problem, it has been proposed in the prior art to provide the stay bolts with adjusting apparatuses in order to change their effective length, with the result that changes in the effective length of the stay bolts during operation, as a rule elongations, can be compensated for depending on measured results of a sensor for detecting the straightening gap in real time. An example for this is found in EP-A-1 673 181.

Since high forces act on the stay bolts during the straightening, and forces which are likewise correspondingly high are required to compensate for an increase in the effective length of said stay bolts, the adjusting apparatuses which are proposed in the prior art are equipped with hydraulic piston/cylinder units. The latter can generate and maintain the required forces in the required short reaction time. It is disadvantageous here, however, that a straightener which is equipped with adjusting apparatuses of this type has to be provided with an additional hydraulic system. Hydraulic systems which are not necessary in the case of a straightener without adjusting apparatuses are structurally complicated, however, and are intensive in terms of energy and maintenance. Moreover, their long-term service life leaves a lot to be desired in comparison with the other parts of a straightener of the present type, insofar as oil losses cannot be tolerated.

SUMMARY

The present invention is therefore based on the object of simplifying the construction and maintenance requirement of a straightener of the type mentioned at the outset, without functionality being sacrificed.

This object is achieved by way of a straightener having one or more features of the invention. Preferred refinements and developments of the straightener according to the invention are described below and in the claims.

According to the present invention, the adjusting apparatuses for the stay bolts are therefore no longer operated hydraulically, but rather mechanically or electromechanically, by the effective length of the stay bolts being changed by way of a mechanically movable sliding wedge. A sliding wedge of this type is capable of generating very high vertical forces which are necessary for an adjusting apparatus for stay bolts, with relatively low horizontal forces which displace the wedge.

A hydraulic system for actuating the adjusting apparatuses of the stay bolts is therefore superfluous. The mechanically movable sliding wedge is preferably actuated by way of an electric motor, for example a three-phase servodrive. This electric motor expediently acts via a gear mechanism on the sliding wedge, a worm gear mechanism, in particular, being used which interacts with a spindle which for its part moves the sliding wedge.

An electric servomotor has the advantage that it can interact directly with a preferably existing sensor or a monitoring device which detects the changes in the effective length of the stay bolts. This detection of a change in the effective length of the stay bolts can be carried out on the stay bolts themselves, for example by way of strain gages; the straightening gap is preferably monitored directly, however, the undesired change in which is proportional with a change in the effective length of the stay bolts. An electric motor for actuating the sliding wedge can be configured in a structurally uncomplicated way via a customary electric controller with regulating electronics for the compensation of the elongation, detected by the monitoring device, of the effective length of the stay bolts.

In the context of the present invention, the "effective length" of the stay bolts is not equivalent to the actual length thereof. This is because, even if a stay bolts is elongated, its effective length which is defined with regard to the straightening gap can remain identical, for example by the change in length of the stay bolt being compensated for by a relative movement, brought about by a sliding wedge, between the roll frame which is fastened to the stay bolt and the stay bolt.

According to one preferred development of the present invention, an increase in the effective length of the stay bolts is prevented merely up to a maximum elongation by way of movement of the sliding wedge. If the elongation of the stay bolts goes beyond said maximum elongation, this is a sign that excessively great forces prevail in the straightening gap which not only elongate the stay bolts, but rather also load the straightening rolls, the roll bearings and, in particular, the drives of the straightening rolls which usually comprise articulated shafts. Overloading of the roll drive and, in particular, of the articulated shafts has to be avoided, however, in order to avoid expensive damage which is complicated to repair. If the stay bolts, as provided according to the present invention, are of relatively slim configuration and accordingly yield relatively readily, which is compensated for by the sliding wedge during operation by way of the straightening gap regulation according to the invention, the result of this development of the invention is an overload protection system for the straightener.

In the event of imminent overloading of the straightener, the latter does not have to be switched off in principle in the context of the present invention, however: even if the forces in the straightening gap threaten to become so high that damage of the machine and, in particular, of the articulated shafts is to be feared, the plasticization of the material can be canceled out according to a suitable algorithm, for example based on material-specific calculation models, by the increase in the effective length of the stay bolts no longer being compensated for completely. It is advantageous here if the sliding wedges of the individual stay bolts can be moved independently of one another. Although the straightening result of a metal sheet which is currently running in the straightening gap is not optimum in a case of this type, it is nevertheless usable or still satisfactory in many cases, and the straightener has been protected effectively against overloading. If the straightener were stopped via a conventional overload switching means, the metal sheet which was currently being straightened would have been waste as a rule.

The movable sliding wedge preferably forms a wedge adjusting mechanism which is known per se together with a corresponding wedge which is connected fixedly to the stay bolt or to one of the roll frames, which wedge adjusting mechanism is arranged according to the invention on the mounting bracket of the stay bolt on one of the roll frames. The combination of a sliding wedge and a fixed corresponding wedge with identical wedge angles makes a defined change in the spacing of two plane-parallel planes with respect to one another possible: if the sliding wedge is pushed in, the first plane of the sliding wedge and the second plane of the corresponding wedge move away from one another in a plane-parallel manner, whereas they move toward one another if the sliding wedge is pulled out of the arrangement. Here, the sliding wedge is preferably arranged on one of the roll frames, whereas the corresponding wedge is connected fixedly to the stay bolt; this is because the sliding wedge can then be moved along the roll frame and the preferably existing electric motor can be fastened fixedly with the gear mechanism on the roll frame. The sliding wedge does not then move vertically relative to the roll frame.

The sliding wedge and the corresponding wedge are preferably arranged in a housing or frame which is preferably filled with a friction-reducing fluid and is fastened on one of the roll frames.

In order to facilitate pushing in and pulling out of the sliding wedge into/from the wedge adjusting mechanism and in order to reduce any wear, it is particularly preferred in the context of the present invention if the sliding wedge is provided on at least one of its two wedge faces with a roller shoe. This roller shoe preferably comprises a number of rollers which are mounted by way of needle bearings in a cage. By way of roller shoes of this type, the movement of the sliding wedge is possible in a relatively light and practically wear-free manner, even under very high load. The electric motor and the gear mechanism for actuating the sliding wedge can correspondingly be held in an uncomplicated manner.

In order to prevent the roller shoe from moving out of the surfaces which roll on one another after a multiplicity of actuations of the sliding wedge, on account of the participating oblique planes, the cage of the roller shoe is preferably guided positively on the participating surfaces. This positive guidance preferably comprises a toothed rack and a corresponding gearwheel, the gearwheel expediently being arranged on the cage of the roller shoe, whereas the toothed racks are seated in the wedge faces.

BRIEF DESCRIPTION OF THE DRAWINGS

Further advantageous features of the invention result from the following description of one specific exemplary embodiment for a straightener which is configured according to the invention and will be explained using the appended drawings, in which.

DETAILED DESCRIPTION OF THE PREFERRED EMBODIMENTS

Figure 1:
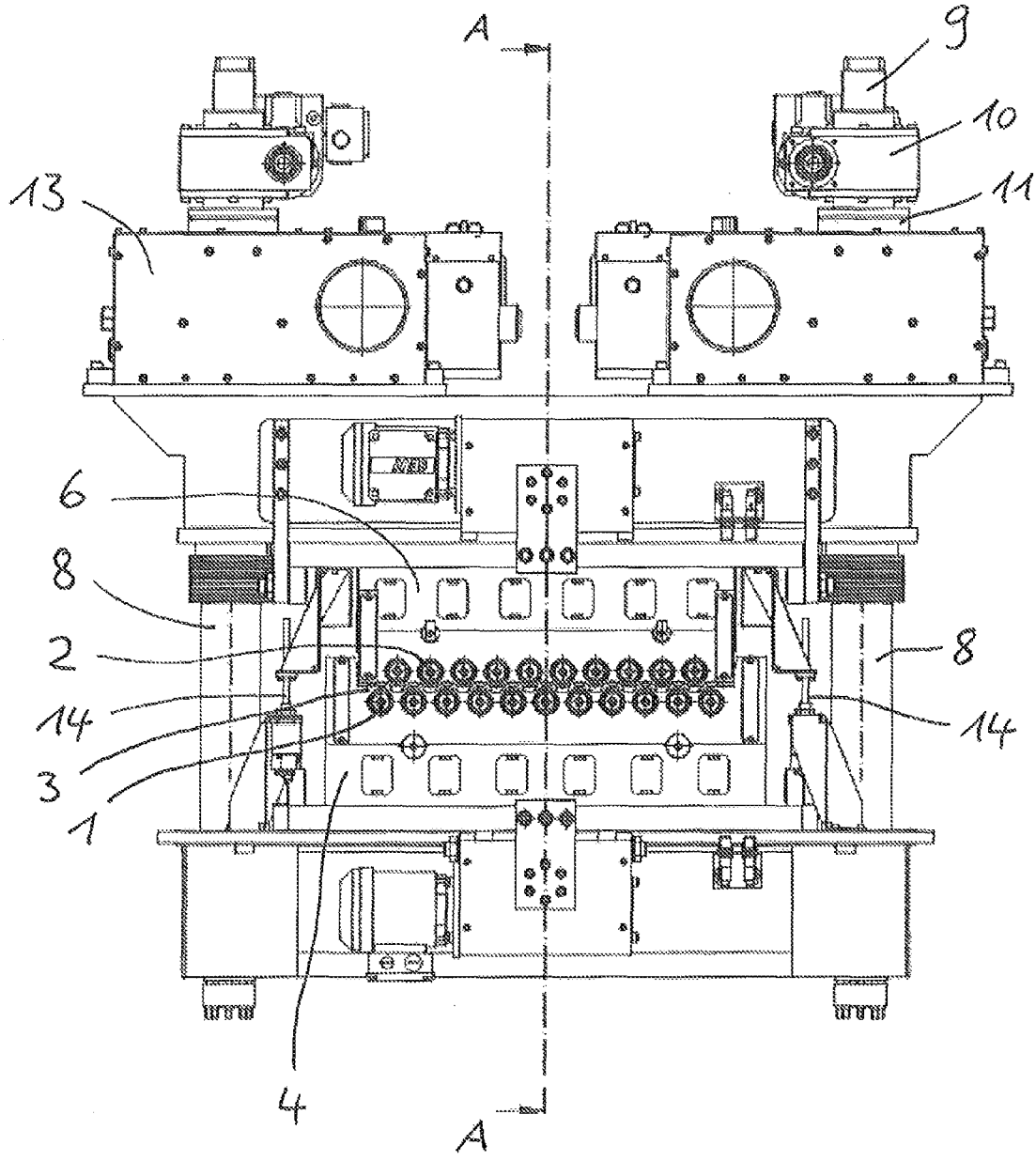
FIG. 1 shows a side view of a straightener which is configured according to the invention.
Figure 2:
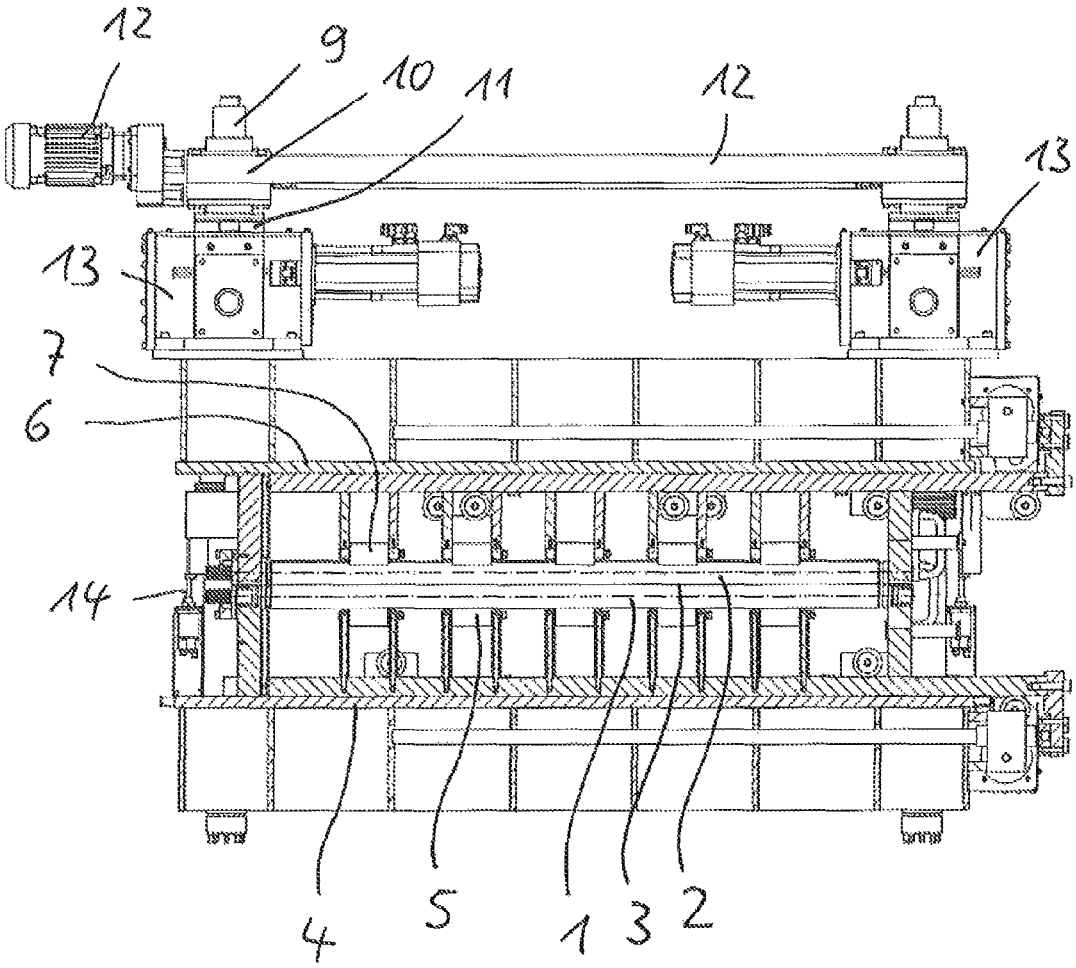
FIG. 2 shows a section along the line A-A from FIG. 1.
Figure 3:
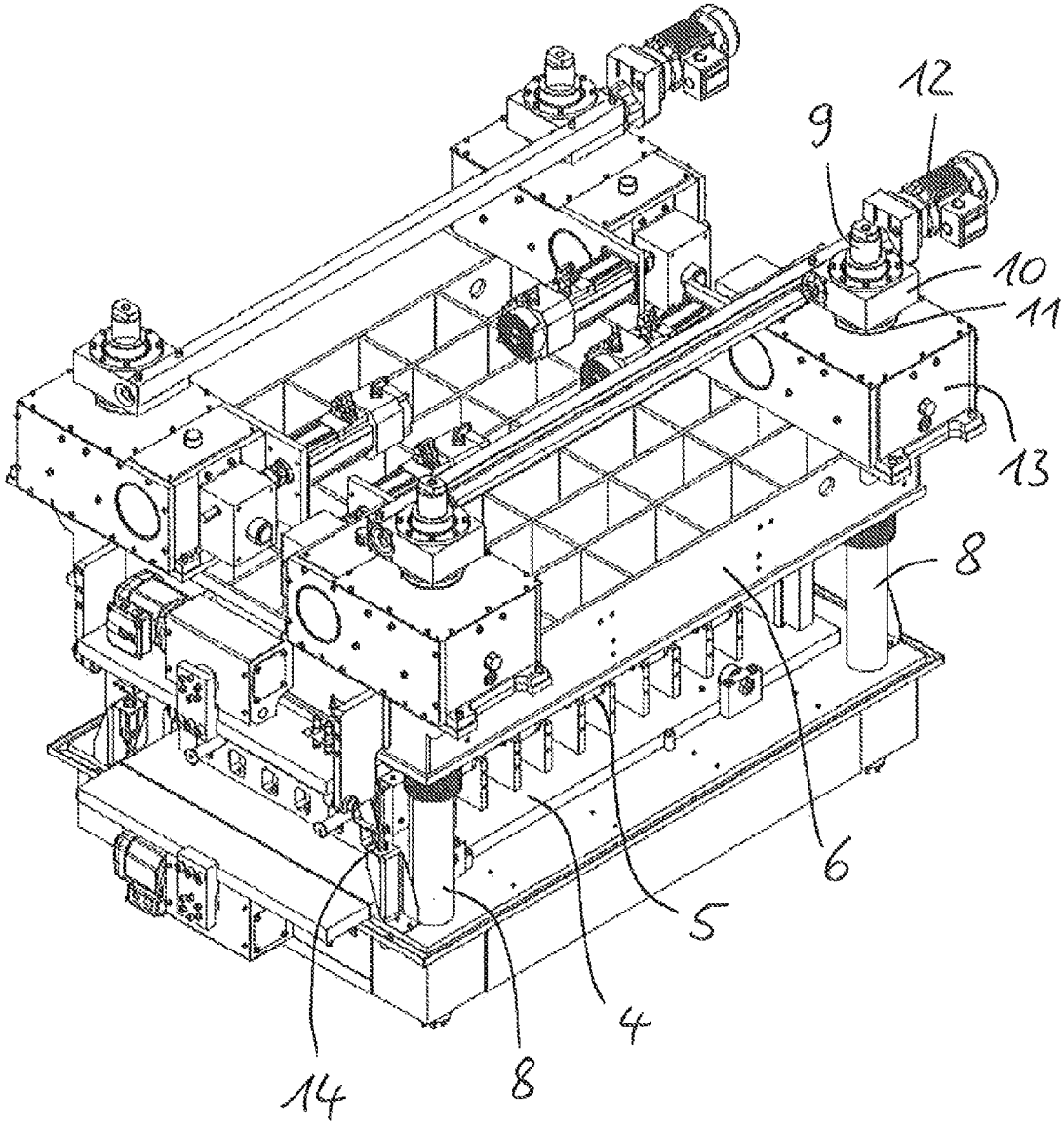
FIG. 3 shows a perspective view of the straightener from FIGS. 1 and 2.

The straightener which is shown in FIGS. 1, 2 and 3 comprises, as A centerpiece, a row of lower straightening rolls 1 and a row of upper straightening rolls 2 which are arranged above one another in such a way that a straightening gap 3 is formed which runs from an inlet side (shown on the left in FIG. 1) of the straightener as far as an outlet side (shown on the right in FIG. 1) in a type of sinuous line between the lower and upper straightening rolls 1, 2. A flat metal part or metal strip (not shown) to be straightened is therefore bent downward around the first lower straightening roll 1, is then bent upward around the first upper straightening roll 2, is bent downward again around the second lower straightening roll 1, and so on in this way in an alternating manner.

The lower straightening rolls 1 are mounted in a lower roll frame 4 and are supported in the roll frame 4 by a multiplicity of supporting rollers 5. In a corresponding way, the upper straightening rolls 2 are mounted in an upper roll frame 6 and are supported against the straightening pressure by upper supporting rollers 7 in the roll frame 6.

The lower roll frame 4 and the upper roll frame 6 are connected to one another in their four corners by means of four stay bolts 8. These stay bolts 8 are anchored fixedly in the lower roll frame, whereas they are fastened adjustably to the upper roll frame 6: in each case one worm gear mechanism 10 is seated at the upper end 9 of the stay bolts 8, via which worm gear mechanism 10 the stay bolt 8 is connected to a counter bearing 11 which is attached to the upper roll frame 6. The worm gear mechanism 10 serves to set the straightening gap 3 during setting up of the straightener: by use of the worm gear mechanism 10 and a drive 12, the height of the upper roll frame 6 can be set with respect to the lower roll frame 4.

The adjusting apparatuses 13 according to the invention for changing the effective length of the stay bolts 8 are then arranged between the counter bearing 11 for the stay bolts 8 and the upper roll frame 6. These adjusting apparatuses 13 are connected fixedly on one side to the upper roll frame 6 and on the other side carry the counter bearing 11 for the stay bolts 8. The height of the counter bearing 11 with respect to the upper roll frame 6 can be changed by means of the adjusting apparatuses 13, with the result that an elongation of the stay bolts 8 can be compensated for by upward displacement of the counter bearings 11, since the mounting of the stay bolts 8 on the upper roll frame 6 can therefore also be "elongated" in a corresponding way. To this extent, the adjusting apparatus 13 does not change the length of the stay bolts 8, but rather only their effective length which is proportional to the straightening gap 3.

When a part to be straightened runs through the straightening gap 3 between the upper and lower straightening rolls 1, 2, the force flow of the opposing forces runs from the upper roll frame 6 through the stay bolts 8 into the lower roll frame 4. Here, the stay bolts 8 are elongated, the elongation being more pronounced the less complicated and thinner the configuration of the stay bolts 8. As a result of the elongation of the stay bolts 8, the straightening gap 3 widens, which can lead to an incorrect or unsatisfactory straightening result. A control unit (not shown) is therefore activated by four monitoring apparatuses 14 which detect the widening of the straightening gap 3 at the level of the four stay bolts 8, which control unit actuates the four adjusting apparatuses 13, with the result that said control unit increases the spacing between the upper roll frame 6 and the counter bearings 11. As a result, the upper roll frame 6 is again moved against the lower roll frame 4, with the result that the straightening gap 3 is reduced again to its setpoint dimensions and the elongation of the stay bolts 8 is compensated for. Accordingly, despite elongation of the stay bolts 8 having taken place, the effective length of the stay bolts 8 has remained unchanged overall, with the result that the straightening gap 3 which is proportional to the effective length has also not changed.

Since a monitoring device 14 is arranged in the vicinity of each stay bolt 8, the four adjusting apparatuses 13 can also be actuated individually, depending on the individual elongation of the respective stay bolt 8.

Figure 4:
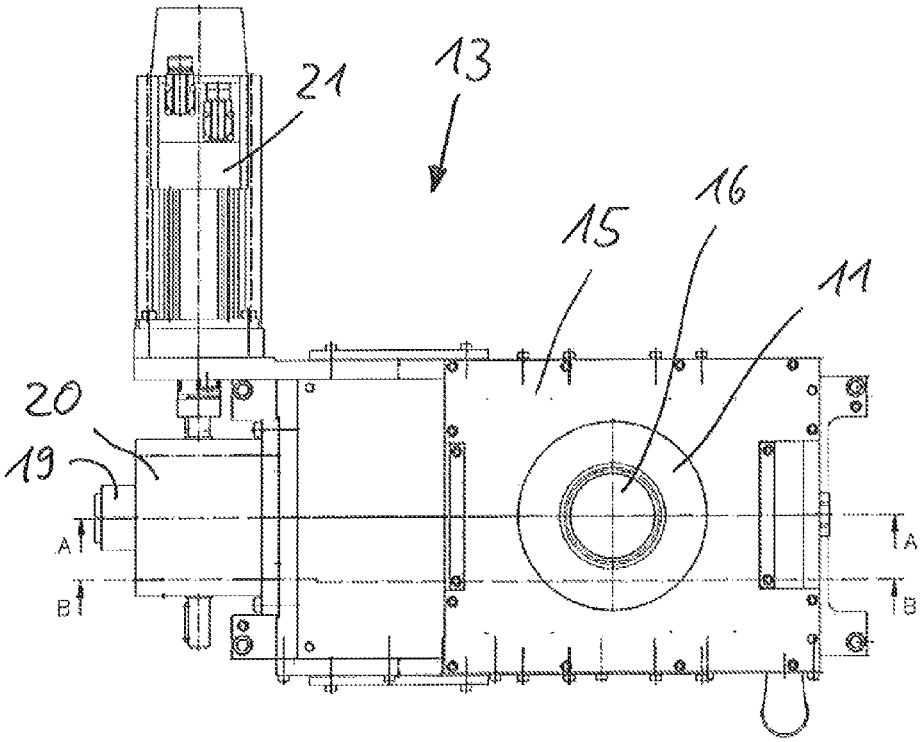
FIG. 4 shows a plan view of an adjusting apparatus from above.
Figure 5:
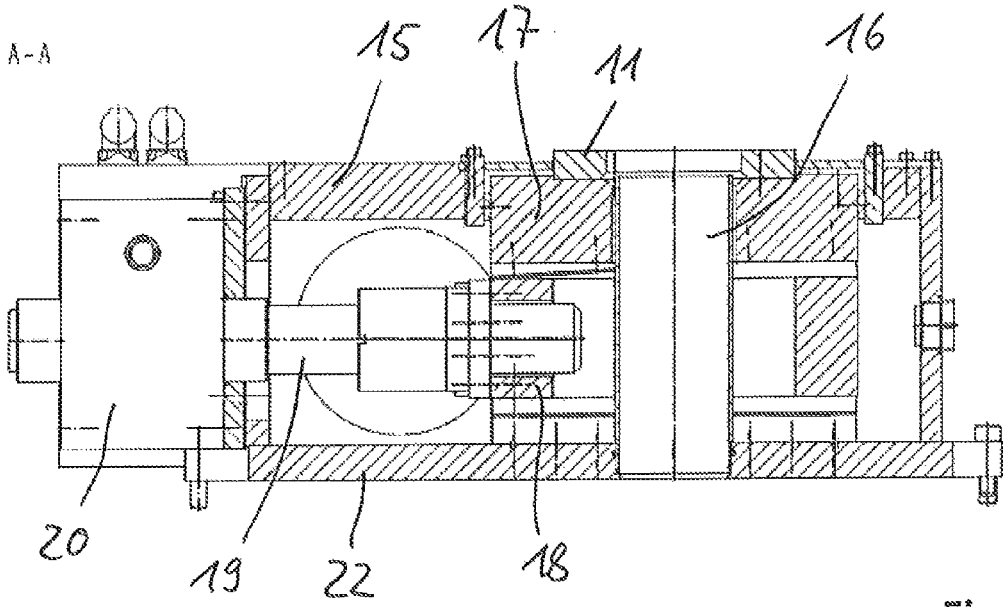
FIG. 5 shows a section along the line A-A from FIG. 4.
Figure 6:
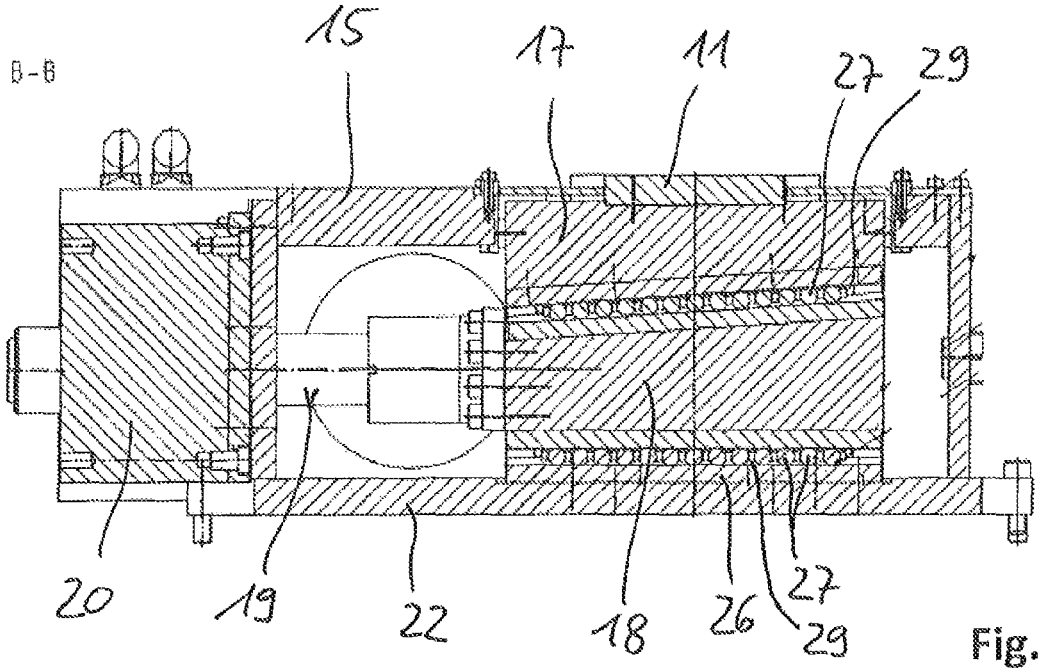
FIG. 6 shows a section along the line B-B from FIG. 4.

The construction of the adjusting apparatuses will be clarified using FIGS. 4, 5 and 6, FIG. 4 being a plan view of an adjusting apparatus 13, whereas FIGS. 5 and 6 are sectional illustrations A-A and B-B, respectively, from FIG. 4.

The adjusting apparatus 13 according to the invention comprises a housing 15 with a leadthrough 16 for the stay bolt (not shown here) which is supported on the counter bearing 11. The counter bearing 11 is supported for its part on a corresponding wedge 17 which interacts with a sliding wedge 18. The sliding wedge 18 can be moved horizontally via a spindle 19 and a worm gear mechanism 20 by an electric motor 21, as a result of which, in interaction with the corresponding wedge 17, the spacing between a bottom 22 of the housing 15 and the counter bearing 11 can be changed. By pushing in of the sliding wedge 18, that is to say by way of a pulling movement of the spindle 19, the corresponding wedge 17 is pressed upward, as a result of which the counter bearing 11 is likewise pressed upward and the effective length of the stay bolt 8 is therefore shortened. Pulling out of the sliding wedge 18, which is associated in the present case with a pushing movement of the spindle 19, leads to lowering of the corresponding wedge 17, with the result that the counter bearing 11 is also lowered and the effective length of the stay bolt 8 is therefore increased.

Since the sliding wedge 18 can be moved horizontally in a flat manner on the bottom 22 of the housing 15 or on the sliding rail 26 which is situated thereon, no changes in height with respect to the upper roll frame 6 result during actuation of the sliding wedge 18 for the drive 20, 21 of the sliding wedge. The wedge angle of the sliding wedge 18 and of the corresponding wedge 17 are co-ordinated with one another, with the result that those wedge faces of the two wedges 17, 18 which face away in each case from the other wedge lie in a plane-parallel manner with respect to one another and can be moved toward one another or away from one another in a plane-parallel manner.

Furthermore, the wedge angle of the sliding wedge 18 and of the corresponding wedge 17 is selected in such a way that there is a high force transmission ratio from the horizontal movement of the sliding wedge 18 to the vertical movement of the counter bearing 11. In this way and with a suitable transmission ratio of the worm gear mechanism 20, the forces which are necessary for the compensation for an elongation of the stay bolts 8 can be applied by a relatively small and inexpensive servomotor 21.

Figure 7:
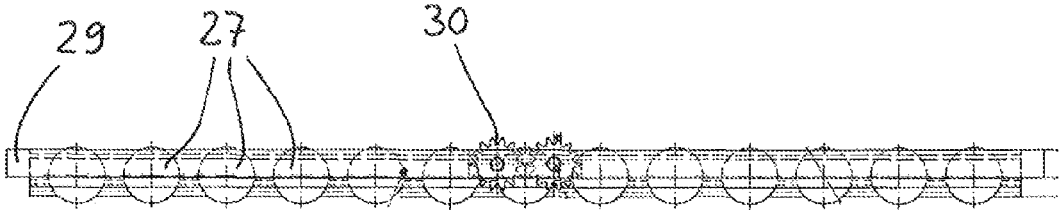
FIG. 7 shows a side view of a roller shoe.
Figure 8:
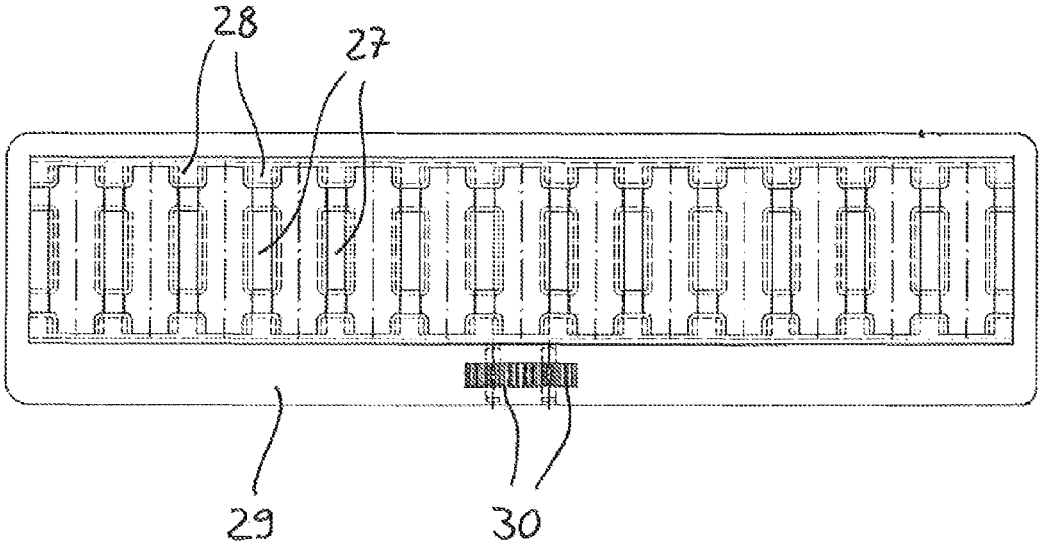
FIG. 8 shows a plan view of the roller shoe from FIG. 7.

In order to reduce the frictional forces between the two wedges 17, 18 and between the sliding wedge 18 and a running rail 26 which is arranged on the bottom 22 of the housing 15, and in order thus to make an actuation of the sliding wedge 18 possible with forces which are as low as possible, roller shoes which are shown in greater detail in FIGS. 7 and 8 are provided in each case between the participating surfaces 23, 24 and 26. The roller shoes are in each case a number of identically configured rollers 27 which are mounted by means of needle bearings 28 in a cage 29. This cage 29 is inserted into the wedge faces 23, 24 or the running rail 26, with the result that the two wedge faces of the sliding wedge 18 run in each case over the rollers 27 on the corresponding faces, namely the wedge face 24 of the corresponding wedge 17 and the running rail 26 of the housing 15.

As, in particular, FIG. 8 clarifies, the cage 29 carries two gearwheels 30 for the rollers 27, moreover, which gearwheels 30, in the assembled state, engage in each case into toothed racks 31 in the wedge faces of the sliding wedge 18 and the corresponding wedge 17 and in the running rail 26. By means of said gearwheels 30 and the toothed racks 31, the cage 29 is guided positively with respect to the surfaces which take part by way of the rollers 27, with the result that said cage 29 cannot move out of its position, for instance laterally.

The invention claimed is:

1. A straightener for straightening a metal strip and/or flat metal parts, comprising a number of lower straightening rolls (1) which are mounted in a lower roll frame (4) and a number of upper straightening rolls (2) which are mounted in an upper roll frame (6), stay bolts (8) which connect the upper and lower roll frame (4, 6) at a preselectable spacing, the stay bolts (8) being assigned adjusting apparatuses (13) for changing an effective length of the stay bolts (8), said effective length defining the preselectable spacing, and the adjusting apparatuses (13) comprise a mechanically movable sliding wedge (18) which changes the effective length of the stay bolts (8) for compensating for changes in said effective length during operation, the sliding wedge (18) is moveable by an electric motor (21), and the electric motor (21) interacts via a gear mechanism (20) with a spindle (19) which moves the sliding wedge (18).

2. A straightener for straightening a metal strip and/or flat metal parts, comprising a number of lower straightening rolls (1) which are mounted in a lower roll frame (4) and a number of upper straightening rolls (2) which are mounted in an upper roll frame (6), stay bolts (8) which connect the upper and lower roll frame (4, 6) at a preselectable spacing, the stay bolts (8) being assigned adjusting apparatuses (13) for changing an effective length of the stay bolts (8), said effective length defining the preselectable spacing, and the adjusting apparatuses (13) comprise a mechanically movable sliding wedge (18) which changes the effective length of the stay bolts (8) for compensating for changes in said effective length during operation, and the movable sliding wedge (18) forms, together with a corresponding wedge (17) which is connected fixedly to the stay bolt (8) or to one of the roll frames (4, 6), the wedge adjusting apparatus (13), and said wedge adjusting apparatus (13) is arranged on a mounting bracket (11) of the stay bolt (8) on one of the roll frames (4, 6).

3. The straightener as claimed in claim 2, wherein the sliding wedge (18) and the corresponding wedge (17) are arranged in a frame or housing (15) which is fastened on one of the roll frames (4, 6), and the sliding wedge (18) is moveable along a side (26) of the housing (15) or frame which faces the roll frame (4, 6), and the corresponding wedge (17) is connected fixedly to the mounting bracket (11) of the associated stay bolt (8).

4. The straightener as claimed in claim 3, wherein the housing (15) or the frame is filled with a friction-reducing fluid.

5. The straightener as claimed in claim 2, wherein the sliding wedge (18) is provided on at least one of its two wedge faces (23) with a roller shoe which comprises a plurality of rollers (27) which are mounted in a cage (29).

6. The straightener as claimed in claim 5, wherein the cage (29) is guided positively on at least one of the sliding wedge (18) or the corresponding wedge (17).

7. A straightener for straightening a metal strip and/or flat metal parts, comprising a number of lower straightening rolls (1) which are mounted in a lower roll frame (4) and a number of upper straightening rolls (2) which are mounted in an upper roll frame (6), stay bolts (8) which connect the upper and lower roll frame (4, 6) at a preselectable spacing, the stay bolts (8) being assigned adjusting apparatuses (13) for changing an effective length of the stay bolts (8), said effective length defining the preselectable spacing, the adjusting apparatuses (13) comprise a mechanically movable sliding wedge (18) which changes the effective length of the stay bolts (8) for compensating for changes in said effective length during operation, and a monitoring device (14) for detecting a change in the effective length of the stay bolts (8), and the monitoring device (14) interacts with the adjusting apparatuses (13).

8. The straightener as claimed in claim 7, wherein the monitoring device (14) is designed to interact with the adjusting apparatuses (13) so that an increase in the effective length of the stay bolts (8) is compensated for up to a maximum elongation by movement of the sliding wedge (18).

* * * * *